United States Patent [19]

Smith

[11] Patent Number: 4,940,967

[45] Date of Patent: Jul. 10, 1990

[54] BALANCED DIGITAL INFRARED DETECTOR CIRCUIT

[75] Inventor: Edgar M. Smith, Millersville, Pa.

[73] Assignee: Burle Technologies, Inc., Wilmington, Del.

[21] Appl. No.: 401,043

[22] Filed: Aug. 31, 1989

[51] Int. Cl.[5] ..... G08B 13/18

[52] U.S. Cl. ..... 340/567; 250/210; 250/340; 307/117; 340/587

[58] Field of Search ..... 340/567, 587, 584, 600; 307/117; 250/340, 210, 217

[56] References Cited

U.S. PATENT DOCUMENTS

| | | | |
|---|---|---|---|
| 3,636,542 | 1/1972 | Apple | 340/555 |
| 3,725,888 | 4/1973 | Solomon | 340/555 |
| 3,840,868 | 10/1974 | Campman | 340/555 |
| 3,858,192 | 12/1974 | Fischer | 340/555 |
| 4,052,716 | 10/1977 | Mortensen | 340/555 |
| 4,242,670 | 12/1980 | Smith | 340/555 |
| 4,364,030 | 12/1982 | Rossin | 340/567 |
| 4,377,808 | 3/1983 | Kao | 340/600 |
| 4,570,157 | 1/1986 | Kodaira | 340/567 |

*Primary Examiner*—Glen R. Swann, III

*Attorney, Agent, or Firm*—Martin Fruitman

[57] ABSTRACT

A digital control circuit uses a single infrared detector to control the clock pulse on a digital counter so that the sensitivity control is based on the length of time a change in infrared radiation persists. A pyroelective detector is located in a voltage divider and the intermediate voltage of the divider is digitally compared to the intermediate voltage in a fixed divider as a digitaly controlled pulse is applied to both dividers. Either an increase or a decrease of infrared radiation causes the digital circuit to permit the counter to be activated.

2 Claims, 1 Drawing Sheet

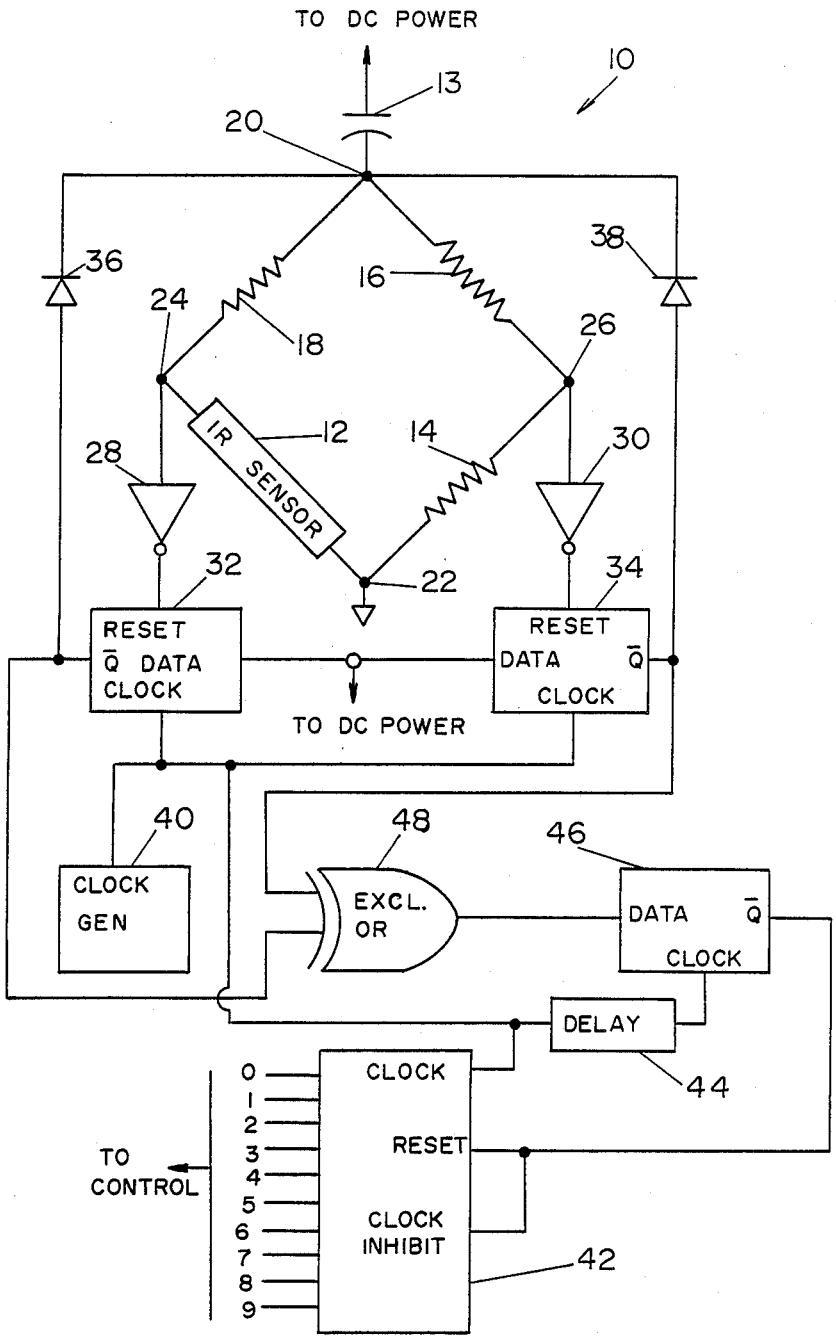
TO DC POWER
10
13
20
36
38
16
24
18
26
IR SENSOR
12
14
28
30
32
22
34
RESET
Q̄ DATA
CLOCK
RESET
DATA
Q̄
CLOCK
TO DC POWER
40
48
46
CLOCK
GEN
EXCL.
OR
DATA
Q̄
CLOCK
DELAY
44
0
1
2
3
4
5
6
7
8
9
CLOCK
RESET
CLOCK
INHIBIT
TO
CONTROL
42

BALANCED DIGITAL INFRARED DETECTOR CIRCUIT

BACKGROUND OF THE INVENTION

This patent deals generally with intrusion detection and more specifically with a circuit which responds to the radiant energy emitted by an intruder to activate an appropriate response.

Intruder detection circuits have become common household items, so much so that they are even used in situations which would not be considered "intrusions". The systems have become so commonplace and have been made so compact that they can now be used to replace common, everyday wall switches for the control of household lights.

In such situations, room or yard lights can be turned on, not only when some unwanted intruder activates the system, but also when residents merely walk through an area, thus automatically furnishing light only when it is needed, and turning the lights off automatically after a specific time period when no person's presence is detected.

However, this very increase in use brings greater demands for reliability and improved suppression of radio frequency interference. When each household has several such intrusion detectors everyone expects those lights to go on only when they are supposed to, and every time they are required to, and no one will tolerate the television picture being interfered with every time the kitchen lights go on.

Yet many existing detector circuits have just such problems. Sensitivity adjustments ca be difficult to set and may vary with room temperature, and radio frequency interference can make the use of radios and televisions difficult in proximity to a detector.

SUMMARY OF THE INVENTION

The present invention improves these situations by using digital control technology in conjunction with a pyroelectric infrared detector circuit. By using digital control technology rather than analog circuitry, the present invention furnishes a highly sensitive but easily adjustable circuit. This is accomplished by a digital circuit which converts the small variations in current from a pyroelectric infrared detector into distinguishable variations in the timing of standard pulses and thus attains an easily distinguishable parameter.

In the circuit of the present invention an internal high frequency clock oscillator is used to produce the required clock pulses by dividing its frequency down through several counters to secure pulses with any desired frequencies and to time periods as long as large portions of an hour. These long times are selected by the user and used in the circuit to sample for a continued presence within the detector's range and to maintain the area lights on if one is found.

The present invention also places a double test on the system prior to activation in order to increase reliability. Not only must the level of infrared signal change sufficiently to indicate a person s presence, but that indication must continue for a specific number of data counts. Thus, a setting of fewer counts makes the system more sensitive while a setting for more counts makes the system less sensitive. Moreover, digital circuitry is inherently less prone to generate radio frequency interference, and a further advantage of the digital circuitry of this invention is that it has very low power requirements. The circuit of the preferred embodiment can be powered from a small 9 volt "transistor" battery, and under such circumstances will operate with no battery replacement for approximately a year.

The present invention also requires only one infrared detector. Many detector circuits are based on the use of two infrared detectors, and optical systems are used to give each detector different but adjacent fields of view. In such systems detection of motion is based on a change in radiation between two adjacent fields. Such systems not only require two or more infrared detectors but relatively complex optics. The present invention needs neither of those.

In the present circuit a single detector is used and no special optics are required to divide the area viewed into separate segments. The infrared detector in the present circuit reacts to any change in total radiation viewed in the entire area monitored, whether that change is due to an increase or decrease in detected radiation. The circuit therefore requires no complex optics, and, in fact, operates quite well with a simple wide angle viewing lens.

The detector circuit of the present invention is essentially two voltage dividers to which a pulse voltage is applied, with the infrared detector replacing one of the resistors in one of the voltage dividers. Under steady state conditions the voltage between the intermediate points of the dividers is balanced, but when energy to the infrared detector is increased or decreased that voltage becomes unbalanced, and an output pulse which is synchronized with the clock, is produced by the detector circuit.

This output pulse is digitally processed and sent to a digital counter which produces a trigger to activate following circuits such as those which turn on lights or activate an alarm.

While the balanced detector circuit has an inherent sensitivity, the digital counter circuit is used for additional sensitivity control. Thus, the sensitivity of the output trigger is based on the number of counts selected before the digital counter is permitted to give an output trigger. The significance of each count is, in effect, a time period between clock pulses from the primary clock generator, and since the circuit only passes through the clock pulse when a change of radiation has occurred within its field of view, the setting of the counter determines for what period of time the detector must sense a continued variation in radiation before an output alarm trigger pulse is produced.

Thus, for example with a 2 Hz clock pulse and a counter setting of six, the change in the radiation field would have to continue for 3 seconds before an output alarm trigger is produced. Such a setting would eliminate most transient or incidental phenomena such as falling leaves or birds flying by, but would still give a satisfactory response time for intruder detection or turning on lights upon entry into a room.

The present invention therefore fulfills the goals of a convenient sensitivity control with minimal radio frequency interference, while also dramatically limiting power consumption and still using only one infrared detector to monitor an entire area.

BRIEF DESCRIPTION OF THE DRAWING

The FIGURE is a simplified schematic diagram of the circuit of the preferred embodiment.

DETAILED DESCRIPTION OF THE INVENTION

The FIGURE is a simplified schematic diagram of the circuit structure of the preferred embodiment of the invention in which the function of detector circuit 10 is based upon a comparison between two voltage divider circuits, wherein infrared sensor 12 and resistor 14 form one voltage divider and resistors 16 and 18 form the second voltage divider. While top end 20 of the divider is connected to a power source (not shown) through capacitor 13 and low point 22 is connected to the circuit return, intermediate points 24 and 26 are the active points which produce signals.

Signal points 24 and 26 are individually connected to voltage sensitive switches and inverters 28 and 30 respectively. Inverter 28 is connected to the reset terminal of digital logic circuit 32 and inverter 30 is connected to the reset terminal of digital logic circuit 34. The data terminals of digital logic circuits 32 and 34 are interconnected with the DC power source, and the output Q bar terminals of both digital logic circuits 32 and 34 are interconnected with top end point 20 through diodes 36 and 38 respectively.

Clock generator 40 furnishes clock pulses for all of the components of detector circuit 10, so it is connected to the clock terminals of digital logic circuits 32 and 34, digital counter 42 and, through delay 44, digital logic circuit 46.

The output Q bar terminals of digital logic circuits 32 and 34 are also each connected to one input terminal of exclusive OR gate 48 whose output feeds the data terminal of digital logic circuit 46. The output Q bar terminal of digital logic circuit 46 is connected to both the reset and clock inhibit terminals of digital counter 42.

OPERATION OF THE PREFERRED EMBODIMENT

The preferred embodiment shown in the FIGURE operates on the basis that, when the intermediate points 24 and 26 of the divider circuits are at the same voltage, that is balanced, under steady state conditions, either an increase or decrease in the energy to infrared detector 12 will generate output pulses synchronized with the pulses from clock generator 40. These output pulses are processed by the digital circuitry which follows the balanced circuit and are delivered to digital counter 42. The output of digital counter 42 can be manually selected to require one or more clock pulses in sequence before it activates the following control circuit (not shown), which turns on either lights or an alarm.

Detector circuit 10 operates as follows. Assume that initially capacitor 13 is discharged by a high level of voltage at either one or both terminals 0 bar of digital logic circuits 32 and 34. Under that condition the voltage at points 24 and 26 is high enough to produce a low level of voltage at the reset terminals of digital logic circuits 32 and 34. As the clock pulse is applied to the clock inputs of digital logic circuits 32 and 34, their outputs Q bar switch low and capacitor 13 begins charging through the parallel paths of resistor 18, sensor 12 and resistor 16, resistor 14 of the voltage dividers.

When capacitor 13 charges to the voltage at which points 24 and 26 reach the voltage at which either or both voltage sensitive switches 28 or 30 act, a high level of voltage is furnished to the reset terminal of the affected digital logic circuit. This changes the output Q bar of the affected unit to a high and capacitor 13 is once again discharged.

As capacitor 13 is discharged the reset terminals of digital logic circuits 32 and 34 go low, but their output 0 bar terminals remain high until the next clock pulse. When the next clock pulse occurs, the cycle repeats with the output Q bar terminals of digital logic circuits 32 and 34 once more being set to a low level voltage.

Under steady state conditions the circuit is balanced and the outputs of digital logic circuits 32 and 34 go high together with every clock pulse. The charging time constants of capacitor 13 and the divider resistors, 14, 16, 18 and sensor 12 are selected so that the outputs of digital logic circuits 32 and 34 occur after approximately one half of the interval between clock pulses has elapsed.

Since both outputs of digital logic circuits 32 and 34 go high together when the circuit is balanced, and these outputs are connected to exclusive OR gate 48, which only furnishes an output when it has only one input, there is no output from exclusive OR gate 48. Therefore when circuit 10 is in its steady state condition with sensor 12 in the preselected state so the voltages at points 24 and 26 vary together no pulse reaches counter 42.

However, as the infrared energy viewed by sensor 12 changes, the circuit operation also changes. In the case for which the energy applied to sensor 12 increases, it increases current through sensor 12 and increases the voltage across resistor 18. Therefore, the voltage at point 24 will reach the input switching level of inverter 28 before inverter 30 reaches its input switching level. Thus digital logic circuit 32 will give a high level output and discharge capicator 13, never permitting digital logic circuit 34 to switch.

Since only digital logic circuit 32 furnishes an output and digital logic circuit 34 remains low during the entire clock pulse interval, exclusive OR gate 48 has its required single input and it furnishes a high level of output during the balance of the clock pulse interval.

Similarly, if the energy applied to sensor 12 is reduced from its steady state level, digital logic circuit 34 will operate before digital logic circuit 32 and the output from exclusive OR gate will also be generated, with no distinction between an energy increase or decrease to sensor 12.

The output of exclusive OR gate 48 is applied to the data input of digital logic circuit 46 while the clock input to digital logic circuit 46 is delayed by time delay 44 so that it operates after approximately 90 percent of the interval between clock pulses has elapsed. The Q bar output of digital logic circuit 46 is connected to the reset and clock inhibit terminals of digital counter 42 which receives the undelayed clock pulse.

Under steady state conditions, with no input to digital logic circuit 46 from exclusive OR gate 48, the output of digital logic circuit 46 remains high and counter 42 is set to and remains at zero.

However, when the two voltage dividers of resistor 18 and sensor 12 and resistor 16 and resistor 14 are not in balance, exclusive OR gate 48 has a high output during the latter part of such clock pulse interval. Under this condition, the Q bar output of digital logic circuit 46 is low for as long as the unbalance continues and counter 42, not having a reset or clock inhibit signal, continues to count clock pulses.

As soon as the balanced condition returns digital logic circuit 46 reestablishes an output and counter 42 is reset to zero and prevented from further counting.

The present invention therefore permits the reduction of false triggers and limits the effects of noise by selection of an output of counter 42 which requires more than one count to activate the following control circuit.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and for which Letters Patent of the U.S. are desired to be secured is:

1. A digital control circuit which initiates an output signal which is synchronized with a clock pulse when infrared radiation to which a sensor is exposed varies from a prescribed level, comprising:

an infrared sensor with first and second terminals, the effective resistance of which changes with radiation to which it is exposed, the second terminal being interconnected with a circuit return;

a first resistor one terminal of which is connected to the first terminal of the infrared sensor;

a capacitor one terminal of which is connected to a second terminal of the first resistor with the second terminal of the capacitor connected to a DC power supply;

a second resistor, one terminal of which is connected to the junction of the capacitor and the first resistor:

a third resistor one terminal of which is connected to the second terminal of the second resistor, the second terminal of the third resistor being interconnected with a circuit return, the ratio of the resistance values of the second resistor to the third resistor, being the same ratio as the resistance value of the first resistor to the effective resistance value of the infrared sensor when the infrared sensor is exposed to said prescribed level of infrared radiation;

a first voltage-sensitive switch and inverter, the input of which is connected to the junction of the infrared sensor and the first resistor;

a first digital logic circuit, the reset terminal of which is connected to the output of the first voltage sensitive switch and inverter and with its data terminal connected to the DC power supply;

a first diode with its positive terminal connected to the Q bar output of the first digital logic circuit and its negative terminal connected to the junction of the capacitor and the first resistor;

a second voltage sensitive switch and inverter, the input of which is connected to the junction of the second resistor and the third resistor;

a second digital logic circuit, the reset terminal of which is connected to the output of the second voltage sensitive switch and inverter and with its data terminal connected to the DC power supply;

a second diode with its positive terminal connected to the Q bar output of the second digital logic circuit and its negative terminal connected to the junction of the capacitor and the first resistor;

a clock generator, the output of which is connected to the clock input terminals of the first and second digital logic circuits;

an exclusive OR gate the first input of which is connected to the Q bar output of the first digital logic circuit and the second input of which is connected to the Q bar output of the second digital logic circuit;

a time delay the input of which is connected to the clock generator output; and a third digital logic circuit, the data input of which is connected to the output of the exclusive OR gate, the clock input of which is connected to the output of the time delay, and the output of which thereby changes its status when the radiation level to which the infrared sensor is exposed varies from the prescribed level.

2. The digital control circuit of claim 1 further including a digital counter, the clock input of which is connected to the clock generator, and the reset and clock inhibit terminals of which are connected to the Q bar output of the third digital logic circuit, the digital counter being adjustable so that its output signal will occur on any preselected count.

* * * * *